US011394112B2

(12) United States Patent
Sainz Fuertes

(10) Patent No.: US 11,394,112 B2
(45) Date of Patent: Jul. 19, 2022

(54) ADVERTISING MEDIUM THAT REPEATS 5G TELEPHONE SIGNAL

(71) Applicant: CELLING 5G NETWORK, S.L., Madrid (ES)

(72) Inventor: Guillermo Sainz Fuertes, Madrid (ES)

(73) Assignee: CELLING 5G NETWORK, S.L., Madrid (ES)

( * ) Notice: Subject to any disclaimer, the term of this patent is extended or adjusted under 35 U.S.C. 154(b) by 7 days.

(21) Appl. No.: 17/277,155

(22) PCT Filed: Sep. 18, 2019

(86) PCT No.: PCT/ES2019/070610
§ 371 (c)(1),
(2) Date: Mar. 17, 2021

(87) PCT Pub. No.: WO2020/058548
PCT Pub. Date: Mar. 26, 2020

(65) Prior Publication Data

US 2021/0408676 A1 Dec. 30, 2021

(30) Foreign Application Priority Data

Sep. 19, 2018 (ES) ..... ES201831418U
Jul. 5, 2019 (ES) ..... ES201931154U
(Continued)

(51) Int. Cl.
*H01Q 1/44* (2006.01)
*H01Q 1/12* (2006.01)
(Continued)

(52) U.S. Cl.
CPC ..... *H01Q 1/44* (2013.01); *H01Q 1/1242* (2013.01); *H01Q 1/246* (2013.01); *H01Q 1/42* (2013.01)

(58) Field of Classification Search
CPC ..... H01Q 1/44; H01Q 1/1242; H01Q 1/246; H01Q 1/42
See application file for complete search history.

(56) References Cited

U.S. PATENT DOCUMENTS 5,212,898 A * 5/1993 Dinan ..... G09F 7/18 411/908
6,735,450 B1 * 5/2004 Remmert ..... H04B 1/38 455/67.15

FOREIGN PATENT DOCUMENTS

EP 1455414 A1 9/2004
WO 0217286 A1 2/2002
WO 2011104393 A1 9/2011

OTHER PUBLICATIONS

SCF, "What is a Small Cell", [retrieved on Mar. 17, 2021], retrieved from <Small Cell Forum, https://www.smallcellforum.org/what-is-a-small-cell/>.

* cited by examiner

*Primary Examiner* — Andrea Lindgren Baltzell
(74) *Attorney, Agent, or Firm* — Hayes Soloway P.C.

(57) ABSTRACT

The invention describes a 5G telephone-repeater advertising medium (100, 200, 300, 400), which comprises: a case comprising means for showing an advertising image, the case being configured to contain a 5G telephone-repeater antenna (130, 230, 330, 430); securing means (104, 304, 404) configured to secure the case to a wall or floor (123, 223, 323, 423) on which same is installed; and socket passages (105, 106; 205, 206; 305, 306; 405, 406) located in the case for the entry of an optical fibre socket and of an electrical socket, for connecting to the 5G telephone-repeater antenna (130; 230; 330; 430).

20 Claims, 13 Drawing Sheets

(30) Foreign Application Priority Data

| | | |
|---|---|---|
| Jul. 8, 2019 | (ES) | ES201931155U |
| Jul. 9, 2019 | (ES) | ES201931176U |
| Jul. 16, 2019 | (ES) | ES201931217U |

(51) Int. Cl.
*H01Q 1/24* (2006.01)
*H01Q 1/42* (2006.01)

ADVERTISING MEDIUM THAT REPEATS 5G TELEPHONE SIGNAL

CROSS-REFERENCE TO RELATED APPLICATIONS AND PRIORITY

This patent application claims priority from PCT Patent Application No. PCT/ES2019/070610 filed Sep. 18, 2019, which claims priority from Spanish Utility Model Application No. U 201831418 filed Sep. 19, 2018, Spanish Utility Model Application No. U 201931154 filed Jul. 5, 2019, Spanish Utility Model Application No. U 201931155 filed Jul. 8, 2019, Spanish Utility Model Application No. U 201931176 filed Jul. 9, 2019 and Spanish Utility Model Application No. U 201931217 filed Jul. 16, 2019. Each of these utility model applications are herein incorporated by reference in their entirety.

OBJECT OF THE INVENTION

The present invention generally belongs to the field of wireless mobile phone, and more particularly to 5G technology.

The object of the present invention is an advertising medium designed particularly for housing therein a 5G mobile cell antenna.

PRIOR ART

Data traffic demand through cellular networks by users of mobile phones and smartphones has grown exponentially and will continue to grow for several years. To efficiently address this exponential traffic demand new network technologies and topologies are required, since the current network infrastructures, based on large base stations (macrocells), cannot longer support the growing demand for connections expected in the upcoming years.

In this context, from the advent of the 5G technology a new type of low power access node is being installed, this node having a lower cost and dimensions, allowing for increasing the coverage and bandwidth of the known macrocell base stations. These low power nodes are known as 5G small cells, whose deployment should satisfy the growing demand requirements of the users.

The coverage range of 5G small cells is significantly smaller in comparison with the macrocells, ranging from several meters to several kilometres. Current 5G small cells have a reduced size and, to guarantee a correct coverage, must fulfil a number of specific installation requirements in connection to height, distance between each other, electrical power connection and optic fibre connection. For example, they must be installed at a height of at least three metres (300 cm) and be separated from each other at least one hundred metres.

Therefore, network deployers such as mobile service companies, local governments, and official institutions, among others, must update the infrastructure network for providing a mobile signal in cities and places with high levels of mobile phone transit for meeting the growing demand user needs in city centres. However, the deployment of this technology is not yet being carried out in areas outside city centres due to the high investment costs required.

Furthermore, nowadays both administrations and companies in the field of telecommunications do not have any optimum installation plan, since the urban planning regulations require specific permissions threatening the viability and approval times.

None of the ways considered to date for deploying this network offers a viable and economic solution, since the ideal situation requiring over 600000 5G mobile small cells would entail an exorbitant cost in civil works and installations, while at the same time the execution and installation times are unacceptable.

This situation is currently damaging sectors depending on the deployment of this network and technology for developing their products and services, such as the autonomous and connected vehicle sector; and the logistic sector, having similar use cases in the field of parcel transport.

Currently available data in connection with the road network in Spain show that there are 165686 kilometres, 26393 (Red de Carreteras del Estado, RCE) of which are managed by the Ministry of Industry and are used by 52.1% of the total traffic and 64.6% of the heavy traffic. Similarly, 71325 km are managed by the Autonomous Regions and carry 42.6% of the traffic, and 69968 are managed by the Diputaciones (the support the remaining 5.3% of the traffic). Furthermore, city halls manage (according to the last official data of 1998) 489698 km, 361517 of which are inter-city. Of the whole network, 17163 are large capacity roads (toll motorways, freeways, and multi-lane roads), 11974 km of which belong to the RCE.

With such a number of kilometres of roads, in order to implement the autonomous and connected vehicle the best communication, computation and sensor technology is needed; this is only possible the is a 5G network available. The enormous number of complex operations lacking human intervention requires this type of technology. Exorbitant amounts of data must be transmitted from and to the vehicle. The real time information must be as detailed as possible in the surroundings of the vehicle and according to a certain distance depending on the itinerary: the car must anticipate the events around it for making the right decisions, and therefore it requires a complete communication infrastructure covering those needs.

The immediate future of these networks 5G comprises the evolution of the 14C-V2C communication standard, oriented to improve the security of the vehicle, encompassing V2V (Vehicle-to-vehicle), V2I (Vehicle-to-Infrastructure), V2P (Vehicle-to-pedestrian) y V2N (Vehicle-to-network). The object is to deploy what in the technical literature is known as Rel-25 16 5G NR C-V2X or, translated to a more understandable language, a 5G radio interface for a "vehicle to everything" protocol based on mobile phone cells.

These 5G infrastructures will allow the advent of really autonomous vehicles having "perception" (thanks to high-capacity data transmission sensors), calculating routes in real time, updating the local conditions (by means of 3D maps) in real time or driving in coordination with the rest of vehicles around them.

The next phase in the mobility of the future are smart roads. Roads must move from the current inert function to an active function in connection with the mobility, efficiency, and connectivity with the users of the road, both vehicles and drivers.

In addition to this, the connected vehicle regulations to be implanted in Europe recently considered Wi-Fi technology as a standard. However, thanks to a suggestion made by the Transport European Commission, 21 of the 28 member states of the European Union voted for giving priority to 5G, rejecting Wi-Fi as the standard technology.

In this situation, Europe cannot fall behind the United States and China. These countries have begun a race for obtaining commercial control of the future 5G networks, which are essential for the autonomous vehicle technology where Europe is ahead.

Implanting this technology in our continent may be key for us to gain ground in comparison to our competitors but, in order for this to happen, the deployment of these infrastructures is required.

In parallel, traffic is increasing exponentially worldwide. Nowadays, around one thousand million (1000000000) vehicles move along the roads globally and, by the year 2050, four thousand million (4000000000) vehicles are estimated.

Connected autonomous vehicles are now a reality, and they have the potential to completely change the rules in the sector. But the roads are the critical and universal platform where these technologies must operate.

Unless innovation in road infrastructure evolves at the same time as automotive technology, traffic growth will continue to be a problem, and these technologies will unfold their real potential. The key to promote progress lies at the intersection between technological improvements and innovation in road infrastructures.

Road infrastructures are being redefined. In the past, the road infrastructure was limited to physical components such as barriers or traffic signs, but it now includes digital components such as wireless network technologies and artificial intelligence. The advent of connected autonomous vehicles is pushing the change, since they depend on telecommunication infrastructures to communicate with other vehicles and infrastructures.

Future intelligent infrastructures could offer numerous opportunities for improving the efficiency and security in roads, such as for reducing traffic accident incidence up to 90%.

The ideal scenario in Europe is that all main land transport routes have uninterrupted 5G coverage by 2025. A huge challenge, no doubt.

Pilot test were carried out in controlled and limited areas due to the great cost of the deployment. Similarly, many of the elements in use today do not fulfil the minimum radiofrequency regulations and there is no standardized deployment regulation plan.

In short, there is currently a need in the field to develop new systems allowing for a fast and economic deployment of the 5G network.

DESCRIPTION OF THE INVENTION

The inventors of the present invention developed an advertising medium having the necessary means for the installation of a 5G small cell therein. The problem in connection with the placement of 5G small cells is therefore solved, since cities have a myriad of advertising mediums having several shapes and sizes which, being essentially empty, could house the 5G small cells. Furthermore, since the advertising medium of the present invention has means for installing the 5G small cell, such as for example cable input/output holes, particularly designed fixation plates, etc., the time needed for installing a 5G small cell is greatly reduced.

An additional advantage of the present invention is that the installation of advertising mediums does not require any permission from the corresponding institutions, or else complex civil works. The time needed for installation is therefore further reduced.

In addition, advertising mediums are visually non-aggressive elements that integrate fast in the urban field and, at the same time, they prevent a potential baseless psychosis in connection with a harmful radiation emission from the antennas. The present invention explicitly discloses four types of advertising mediums repeating a 5G telephone signal: pennant, banner, monolith, and billboard.

In this context, the term "5G mobile cell antenna" refers to 5G mobile antennas usually known as small cells. A precise definition of a small cell can be found in webpage https://www.smallcellforum.org/what-is-a-small-cell/.

The advertising medium of the present invention mainly comprises: a housing, fixation means of the housing to a wall or to the ground, and housing outlets. Next, each of these elements is disclosed in more detail:

a) Housing

The housing comprises means for showing an advertising image, said housing being configured for housing therein a 5G mobile cell antenna.

Generally speaking, the housing has a generally flat shape formed by a perimetral rigid frame and side panels. In this context, the expression "essentially flat" refers to a shape where the faces formed by the opposite side panels have a surface that is much greater than the faces formed by the rigid perimetral frame joining them. Therefore, the sides have a large surface suitable for having a very visible advertising image. Furthermore, the shape of the housing is not necessarily limited to a parallelepiped, it could have any type of shape such as, e.g. rectangular, square, oval, circular, or any creative shape provided with the inner volume is large enough for housing the 5G mobile cell antenna.

On the other hand, the housing is preferably made of a plastic material, methacrylate, glass fibre or ABS (Acrylonitrile Butadiene Styrene). This prevents any possible interference caused by metallic parts.

Further, the means for showing the advertising image may have several shapes; these means can be integrated at the side panels of the housing or be formed by additional elements connected to said housing.

In any case, the specific configuration both of the housing and the means supporting the advertising image will depend on the type of advertising medium to install: pennant, banner, monolith, and billboard. Further down below in the present document, a more detailed description of the housing and the advertising image medium in each of these cases is provided.

b) Fixation means

The fixation means are configured for fixing the housing to a wall or ground to which they are to be installed.

The fixation means could be of any type provided they allow for the housing to be fixed to the wall or ground, and they can adopt a number of configurations depending on the type of advertising medium to install: pennant, banner, monolith, and billboard. Further down in the present document a more detailed description of the fixation means corresponding to each of these cases is provided.

c) Outlets

Outlets are provided in the housing for the introduction of a fibre optic cable and an electric supply cable for connection to the 5G mobile cell antenna.

The outlets are provided at the face of the housing closest to the wall or ground to which it is fixed. The outlets are merely orifices having any shape for allowing the introduction of a fibre optic cable and an electric supply cable to be connected to the 5G mobile cell antenna. The outlets may also have a covering made of an insulating plastic material for protection against external weather conditions.

According to a preferred embodiment of the invention, the housing is watertight according to a IP65 superior grade. This feature allows the housing to be installed outdoors in any type of climate while ensuring that moisture cannot cause an electric malfunction.

According to another preferred embodiment of the invention, the housing is further configured for housing a radio transmission/reception equipment. It is an active system based on electromechanics for treating and processing the electrical signals. Additionally, along with the 5G mobile cell antenna and the radio transmission/reception equipment, the housing may also house a coaxial cable, a coaxial signal combiner, and a coaxial signal separator.

According to another preferred embodiment of the invention, to ensure a correct operation of the mobile signal in an independent manner, the housing is also configured for housing a baseband processing unit.

In another preferred embodiment of the invention, the housing can also house a protection electrical panel having magneto-thermal and/or differential switches. Additionally, to ensure a complete electrical protection, the housing may also house an earth connection and a lightning protection device.

According to another preferred embodiment, the advertising medium of the invention further comprises a flexible duct protecting the optic fibre at the entrance to the housing. More specifically, the flexible duct protects the optic fibre from the optic fibre connection to the 5G mobile cell antenna and, when appropriate, any of the auxiliar element the optic fibre is connected to.

In still another preferred embodiment, the advertising medium of the invention further comprises a connection plate provided inside the housing for connecting the 5G mobile cell antenna, the radio transmission/reception equipment and/or the baseband processing unit. The plate may have, for example, a flat elongated shape having regularly spaced tabs stemming therefrom, such that each element (5G mobile cell antenna, radio transmission/reception equipment or baseband processing unit) can be connected to the corresponding tab. Further, the plate may have a plurality of wiring fastening orifices the wiring if fastened to.

In another preferred embodiment of the invention, the housing further comprises an articulated door having watertight gaskets and pneumatic or gas dampeners for an easy opening. The articulated door can be provided on a side and fixed to the perimetral frame by means of, at least, a hinge. The articulated door may further comprise a lock that opens by means of a coded key. Thus, when the lock is actuated, the door opens a certain angle large enough for allowing the operator access to the 5G mobile cell antenna housed inside the housing, as well as to the additional telecommunication equipment needed for the 5G mobile cell antenna to operate suitably.

According to a further preferred embodiment of the invention, the housing further comprises a plurality of ventilation holes. Even more preferably, the advertising medium can additionally comprise a fan and a temperature controlling element actuating the fan when a predetermined temperature is exceeded. This feature ensures a correct operation of the 5G mobile cell antenna in case of adverse weather conditions.

In another preferred embodiment, the advertising medium of the invention further comprise a plurality of illumination object housed inside the housing. The illumination elements can be modules or straps of low power LEDs provided, for example, along the aluminium plate. If necessary, the housing may also house a transformer designed for converting the incoming voltage level in the housing according to the needs of the LED strap.

On the other hand, as disclosed above in the present document, the advertising medium of the invention can be designed according to a number of different configurations, some of which are specifically: pennant, banner, monolith, and billboard. Next, the features of each of these configurations are disclosed in more detail.

1. Pennant

In this case, the advertising medium is shaped as a pennant where:

a) The housing has an essentially flat shape formed by a peripheral rigid frame and non-metallic side panels where the advertising image is provided. The perimetral frame may be made, for example, of lacquered aluminium, and it may have any shape including rectangular, circular, square, and others. The side panels, where the advertising image is provided, can be made of methacrylate or another rigid material, preferably non-metallic, by means of different production and impression methods, including vinyl, die casting, direct impression, etc. The internal volume of the housing is enough for housing one or more 5G mobile cell antennas and the necessary telecommunications auxiliary equipment.

b) The fixation means are provided at the perimetral frame of the housing for allowing a fixation to a vertical wall as a pennant. Specifically, the fixation means can have a plate shape, for example a U-shaped plate having an end connected to the perimetral frame of the housing and the other end having holes or the like for fixing to the vertical wall by means of elements such as screws or the like. Thus, when fixed to a vertical wall, the housing looks like a wall or pennant, since it protrudes perpendicularly from said wall. Thereby, the advertising image is clearly visible from far away.

2. Banner

The advertising medium of this configuration is shaped as a banner where:

a) The housing has an essentially flat shape formed by a rigid perimetral frame and side panels. Specifically, the perimetral frame may be formed, for example, of aluminium, and it may have any shape including rectangular, circular, square, and others. The side panels may be made of aluminium, plastic material, methacrylate, glass fibre, ABS, or other rigid material. The internal volume of the housing is enough for housing one or more 5G mobile cell antennas and the different auxiliary telecommunication equipment.

b) The fixation means are provided on a first side panel of the housing for allowing its fixation to a vertical wall with the side panels in parallel to said vertical wall. That is, in this case the fixation means can merely be orifices provided in the first side panel of the housing, such that the housing can be directly fixed to the panel by means of screws or the like according to a parallel orientation with respect to said wall.

c) The housing further comprises a mast fixed in perpendicular to a second side panel opposed to the first side panel. The mast can in principle be made of any material, such as for example aluminium, plastic, or glass fibre. The mast projects in perpendicular to the vertical wall, and is thus visible from a great distance. Further, according to a particularly preferred embodiment of this configuration of the invention, the rod of the 5G mobile cell antenna may be provided inside the mast. Thereby, the rod of the antenna projects substantially from the vertical wall the advertising medium is fixed to, improving the range while still being hidden from the sight of the pedestrians.

d) A banner having an advertising image is fixed to the mast. The fixation of the banner to the mast can be carried out by means of any fixation means, such as for example by means of eyelets, turn-ups, or strings. The banner may be made of a fabric or, generally speaking, of any flexible material suitable for customization by means of a number of production and impression methods, such as vinyl, digital, sublimation, die casting, direct impression, lamination, and others, for creating advertisements and signalling messages.

3. Monolith

The advertising medium of this configuration has a totem or monolith shape where:

a) The housing has a post or bipost essentially flat shape having a great size and comprising a reinforced metallic frame and non-metallic front panels where the advertising image is provided.

b) The from panels are made by means of different production and impression methods, such as vinyl, die casting, direct impression, etc. and preferably by materials such as methacrylate, plastic, or glass fibre for promoting the emission of the 5G mobile cell antennas. Given the location of the advertising medium in this case, the front panels may have UV and anti-graffiti protection. On the other hand, the metallic frame can be made from, for example, aluminium, and it may have any shape including rectangular, circular, square, or others. The internal volume of the housing is enough for housing one or more 5G mobile cell antennas and the different auxiliary telecommunication equipment.

c) The fixation means may comprise a foundation through which the housing is fixed to the ground as a monolith. The foundation includes a plurality of structural elements supporting the weight of the housing and distributing it such that the admissible load is not exceeded and no local loads appear. The housing is provided in a perpendicular position with respect to the street or ground plane by means of, at least, a shaft resting on a base.

4. Billboard

The advertising medium of this configuration has a billboard shape where:

a) The housing has an essentially flat shape formed by a rigid frame and non-metallic side panels fixed to the frame where the advertising image is provided. The housing may have any shape including rectangular, circular, square, or others. The rigid frame may be made of a metallic material, and the side panels may be made of materials such as methacrylate, plastic, glass fibre or canvas by means of different production and impression methods, including vinyl, die casting, direct impression, etc. The fixation of the side panels to the frame can be made using fixation means such as aluminium plates, screwing, or others, to thereby promote the emission of the 5G mobile cell antennas. The internal volume of the housing is enough for housing one or more 5G mobile cell antennas and the different auxiliary telecommunication equipment.

b) The fixation means comprise at least a rigid, essentially vertical post projecting from the side of the housing for being fixed to the ground as a billboard. The post can be made of a metallic material such as steel, and it is fixed to the ground by means of a foundation. The foundation will include structural elements the charge is transmitted to, such that the admissible load is not exceeded and no local loads appear. The post is fixed in perpendicular to the plane of the ground, street, or road.

PREFERRED EMBODIMENT OF THE INVENTION

Figure 1:
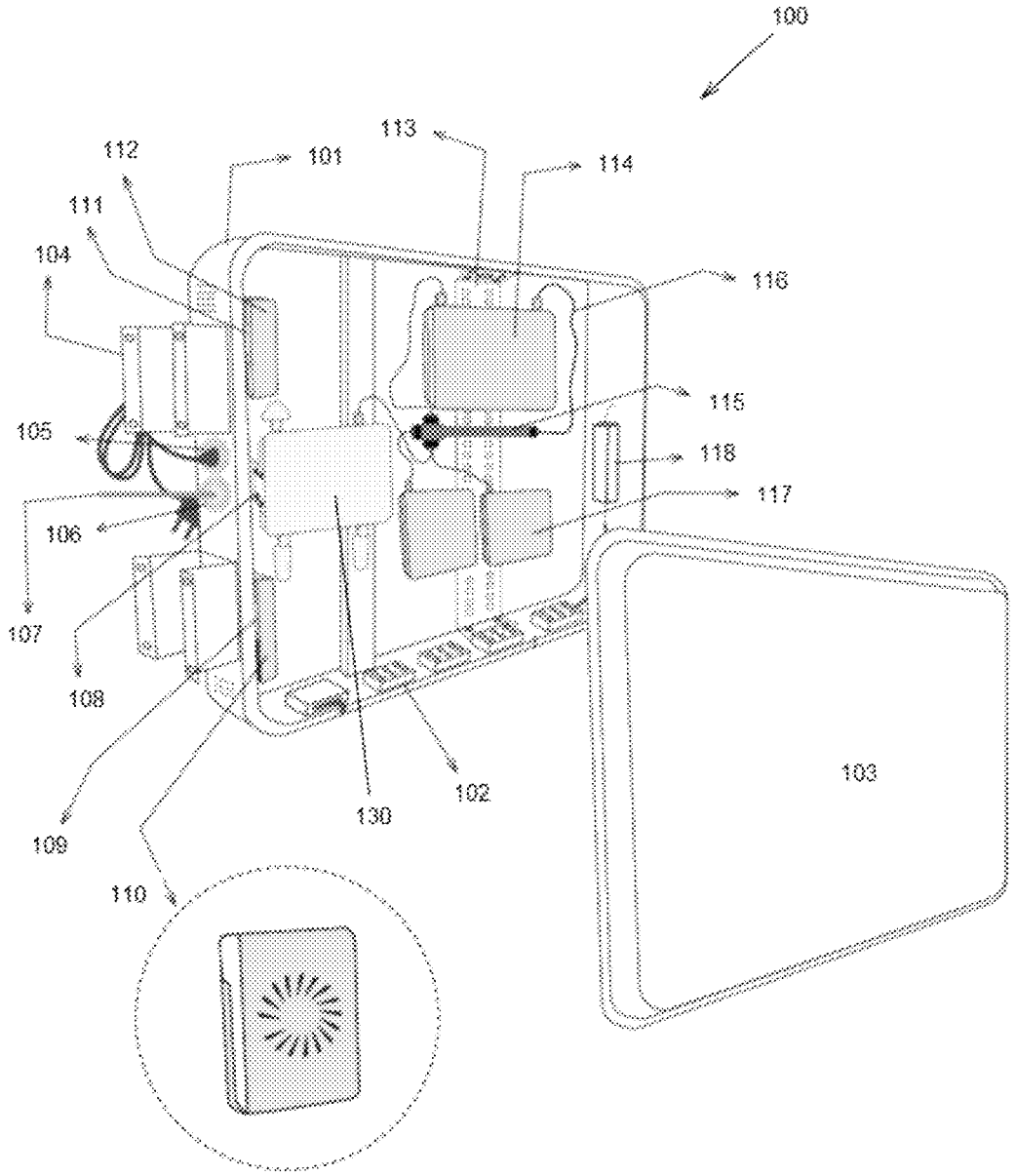
FIG. 1 shows a perspective view of a first example of advertising medium in the form of a pennant with the cover dismounted.
Figure 2:
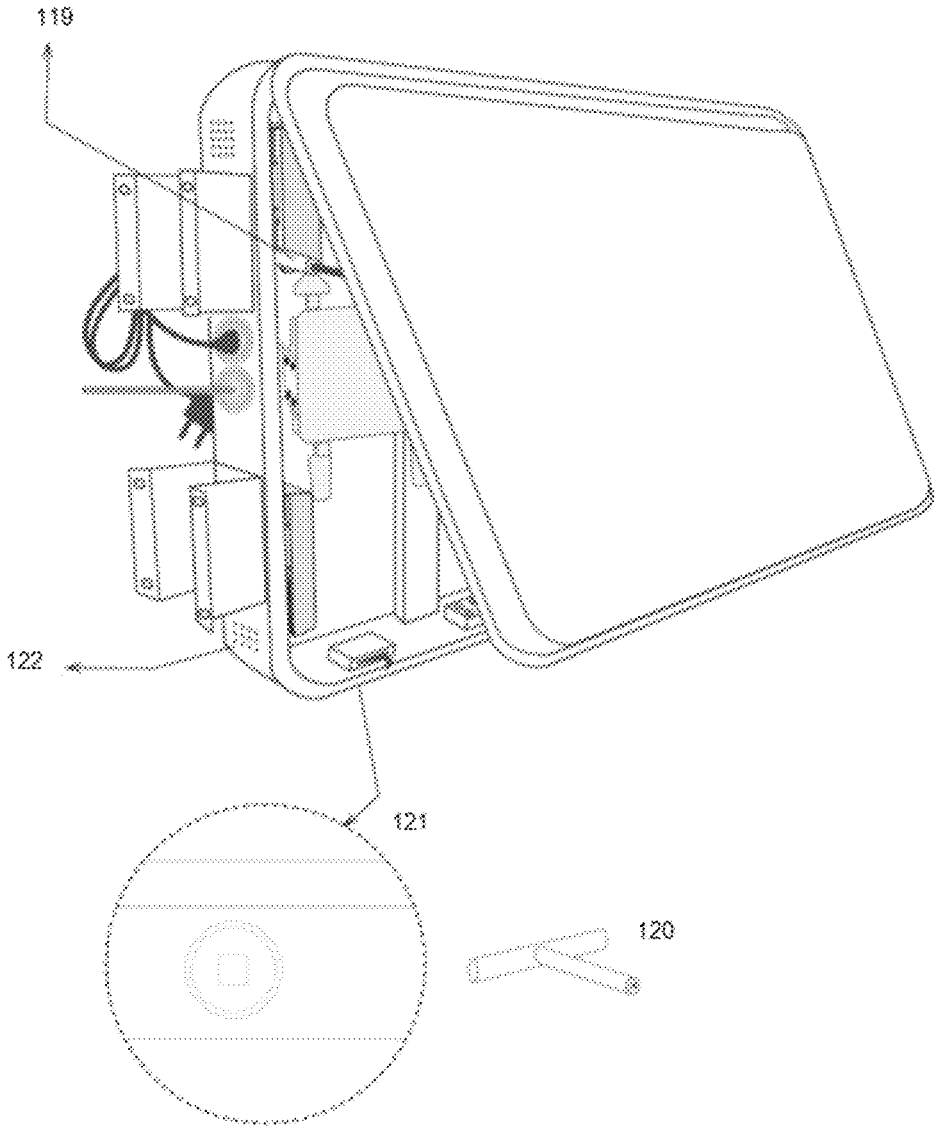
FIG. 2 shows another perspective view of the exemplary advertising medium in the form of a pennant with the cover dismounted and half open.
Figure 3:
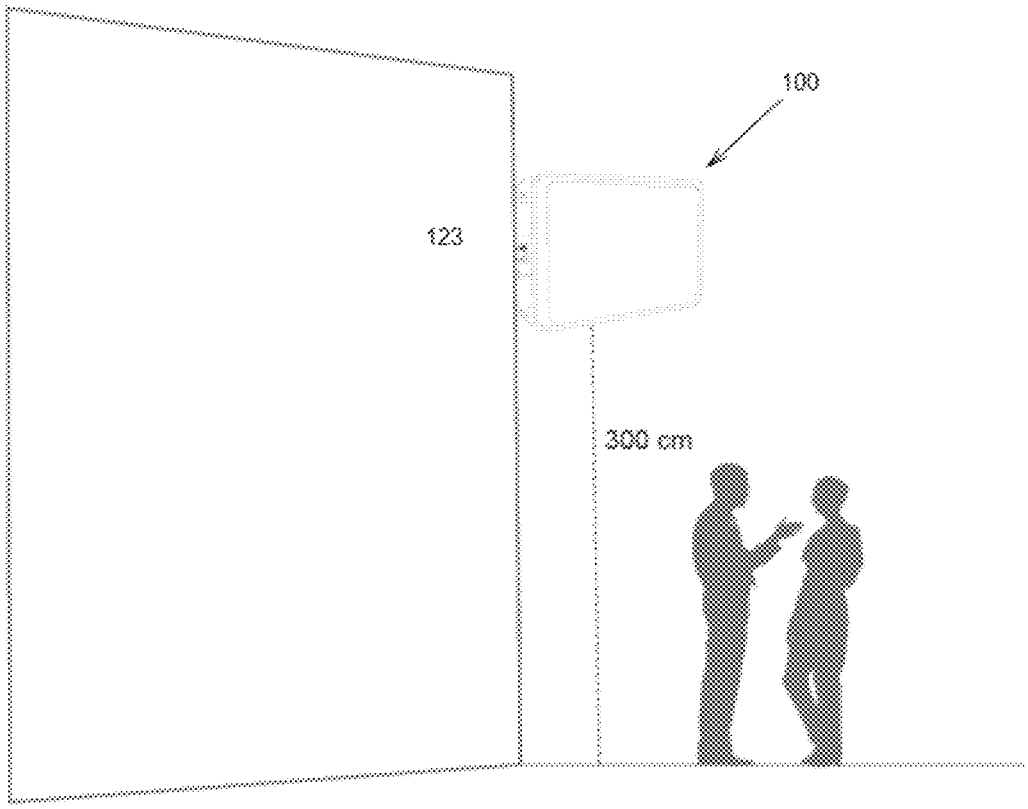
FIG. 3 shows a schematic view of the first exemplary advertising medium in the form of a pennant fixed to a façade.
Figure 4:
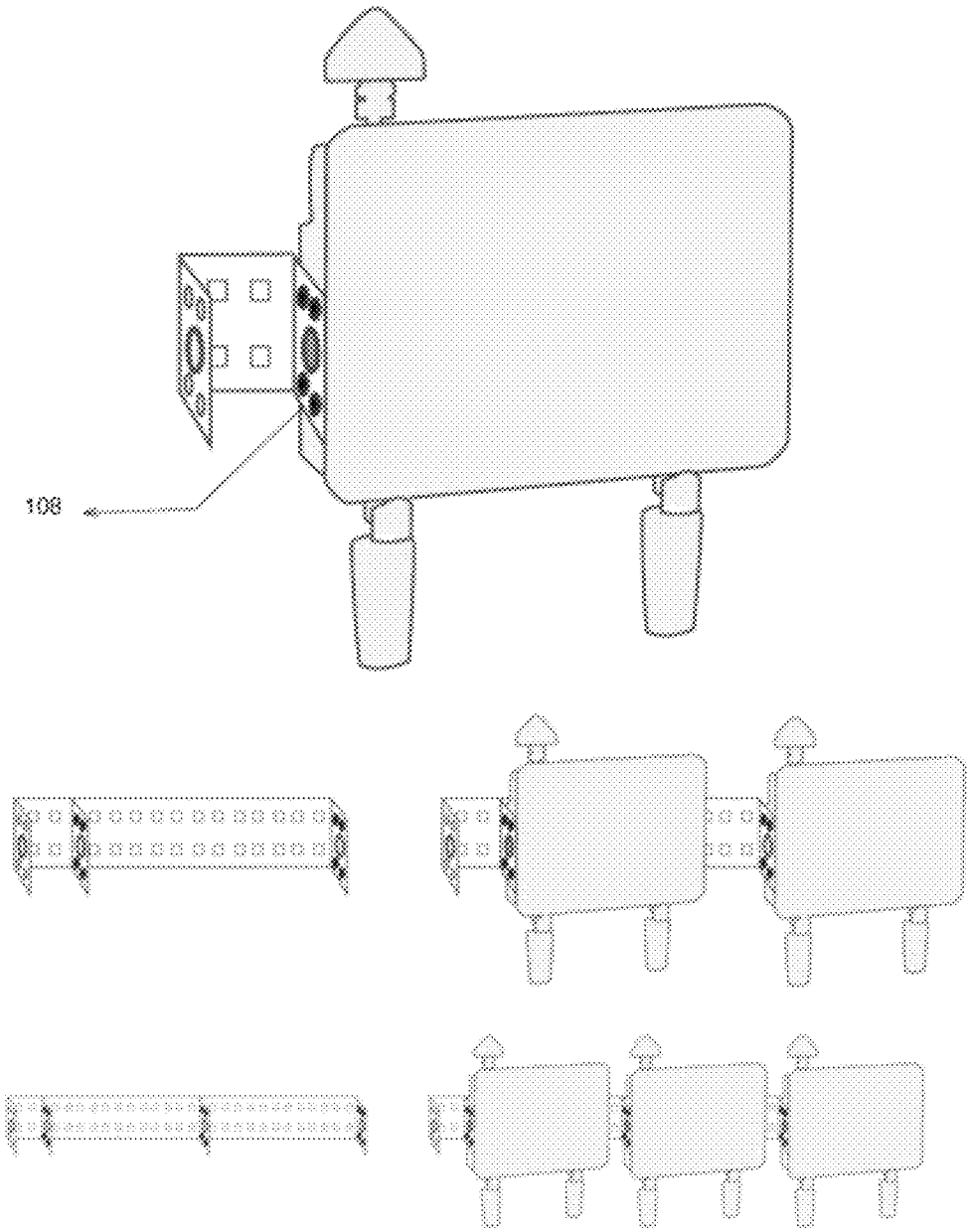
FIG. 4 shows several perspective views of a 5G mobile cell antenna fixed to several models of connection plate of the advertising medium.
Figure 5:
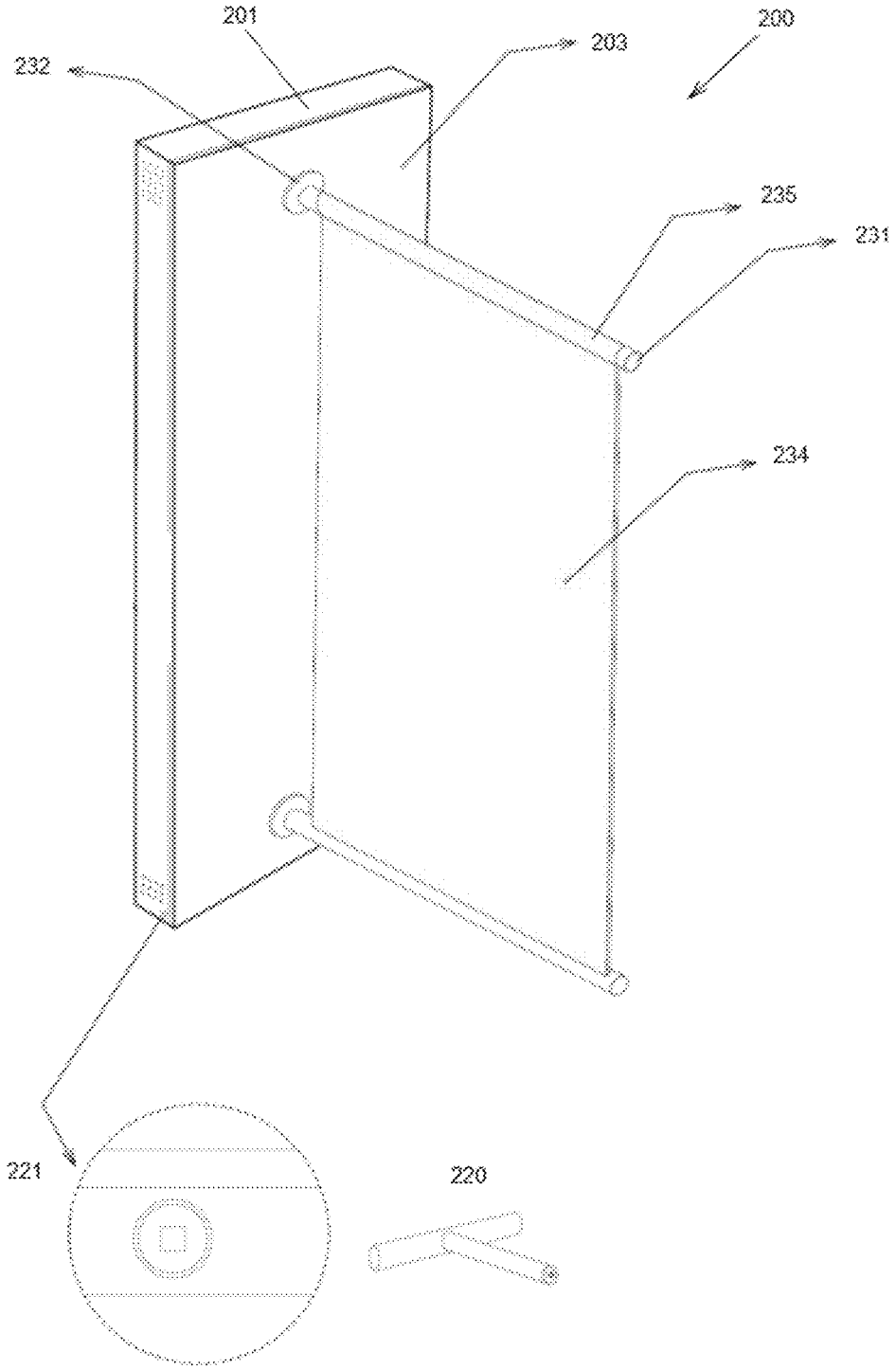
FIG. 5 shows a perspective view of a second exemplary advertising medium in the form of a banner with the cover closed.
Figure 6:
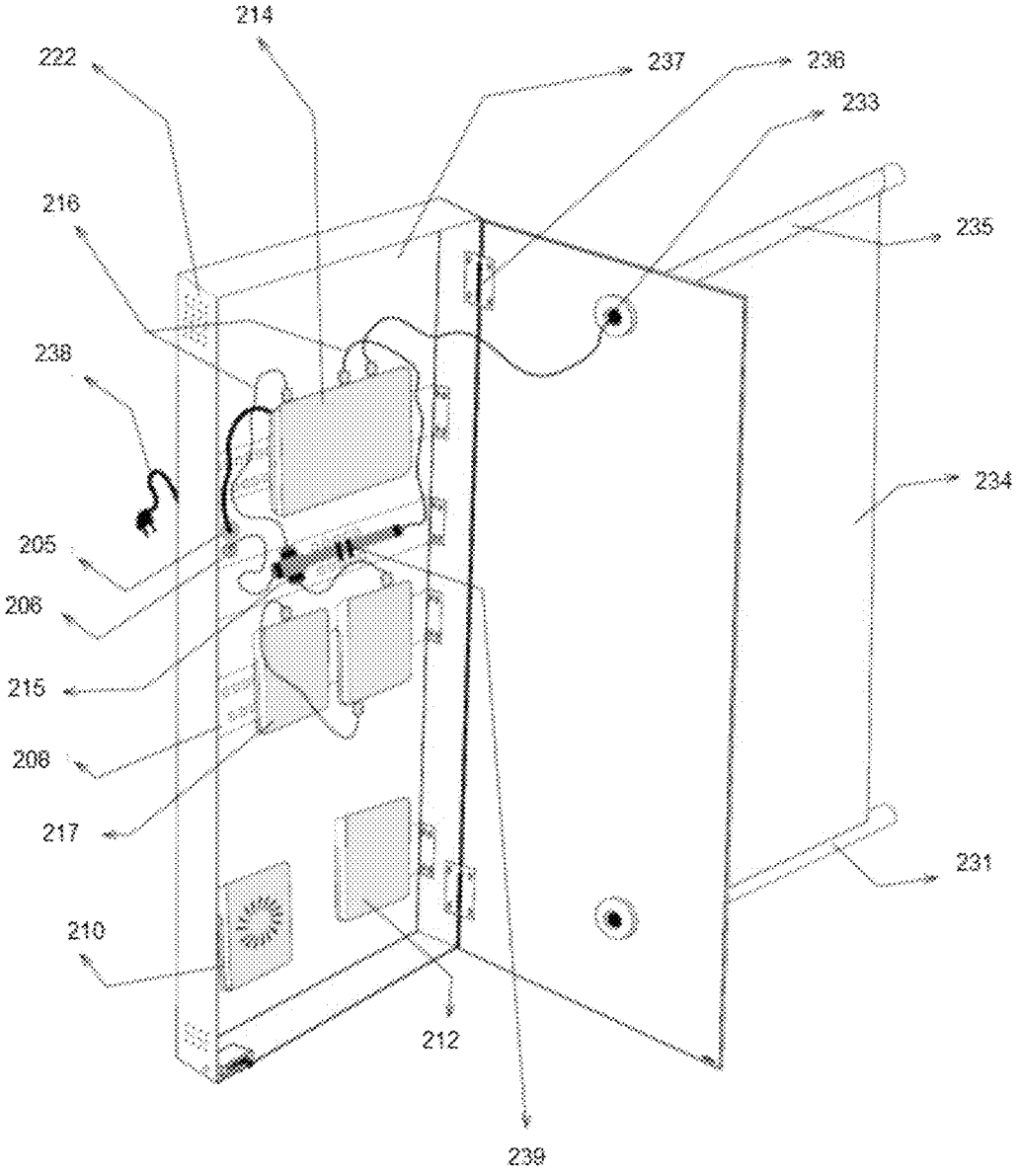
FIG. 6 shows another perspective of the second exemplary advertising medium in the form of a banner with the cover open.
Figure 7A:
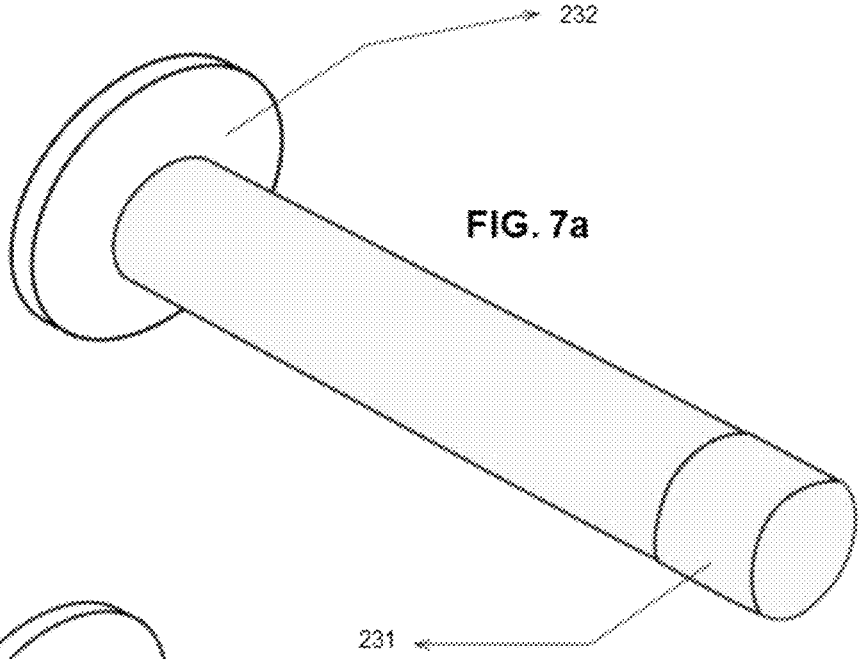
FIGS. 7*a* and 7*b* show a perspective view of a mast according to the second exemplary advertising medium respectively in the closed and open positions.
Figure 7B:
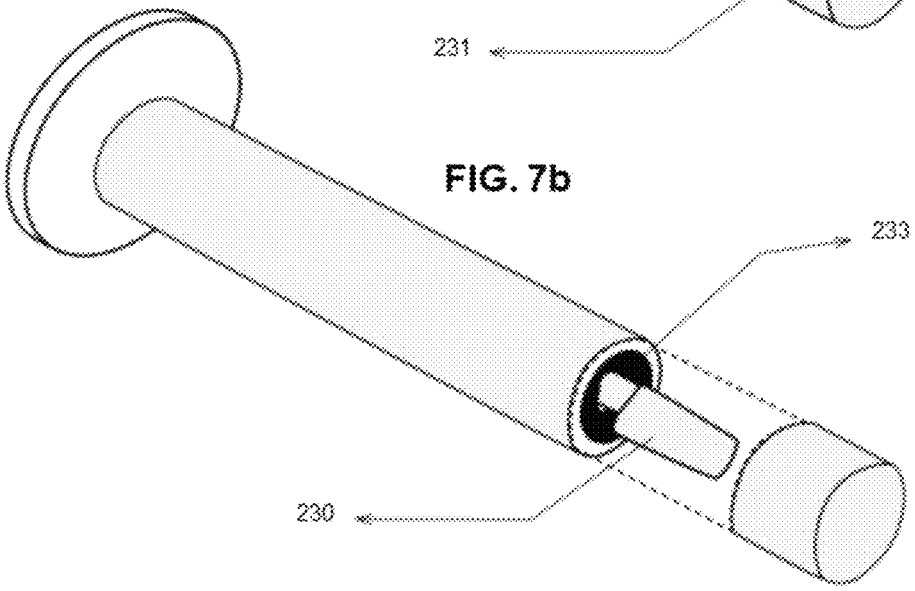
Figure 8:
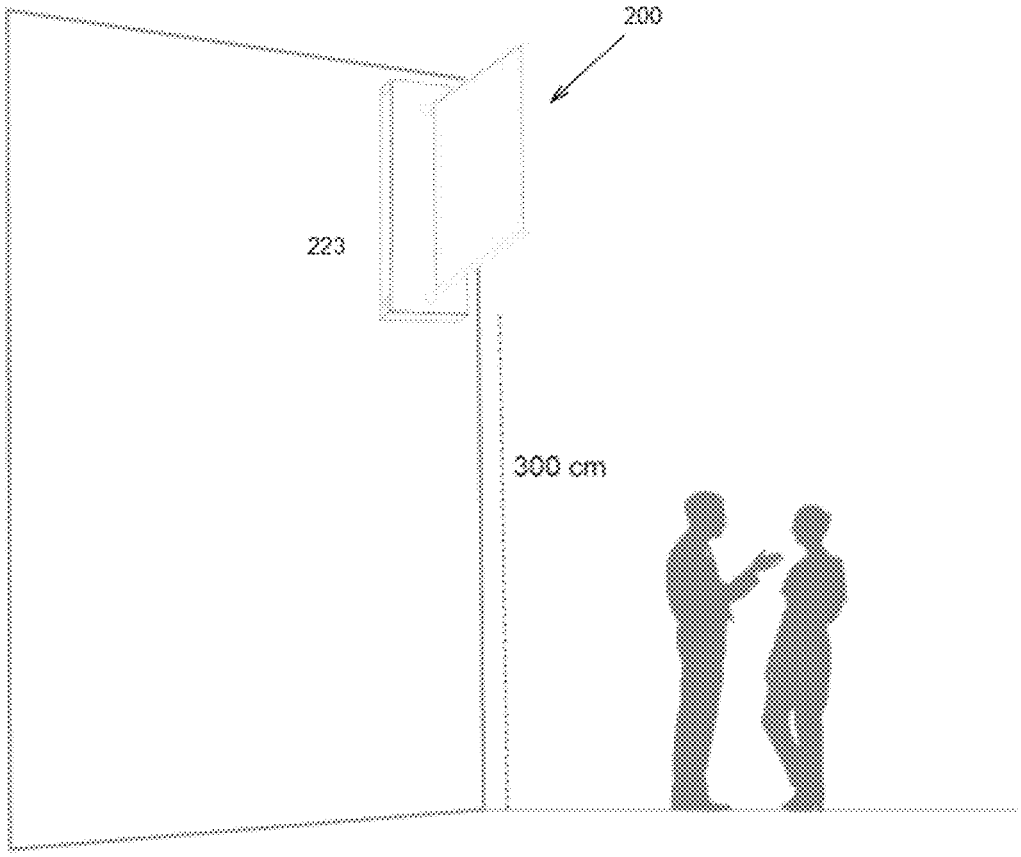
FIG. 8 shows a schematic view of the second exemplary advertising medium in the form of a banner fixed to a façade.
Figure 9:
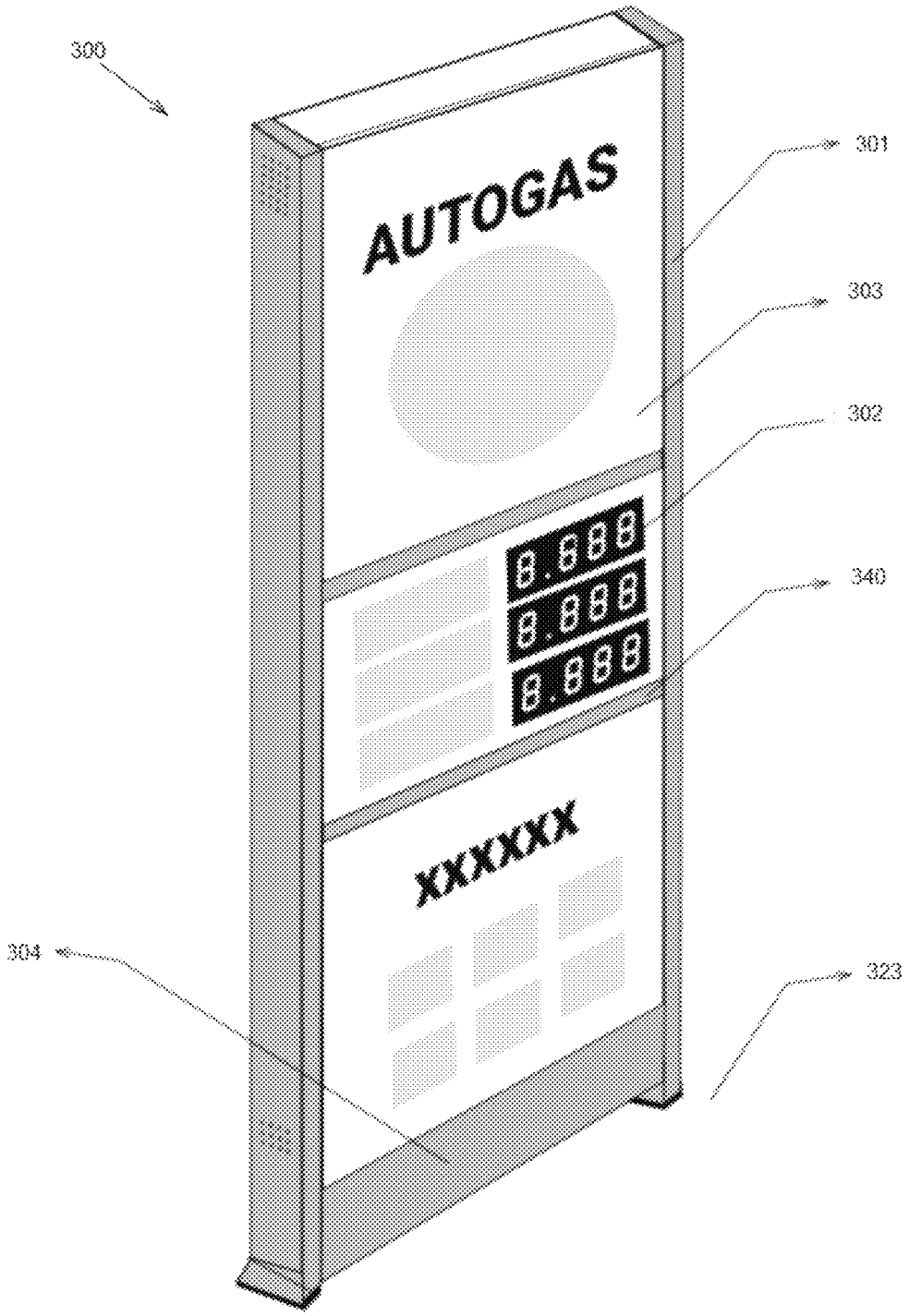
FIG. 9 shows a perspective view of a third exemplary advertising medium in the form of totem/monolith with the cover closed.
Figure 10:
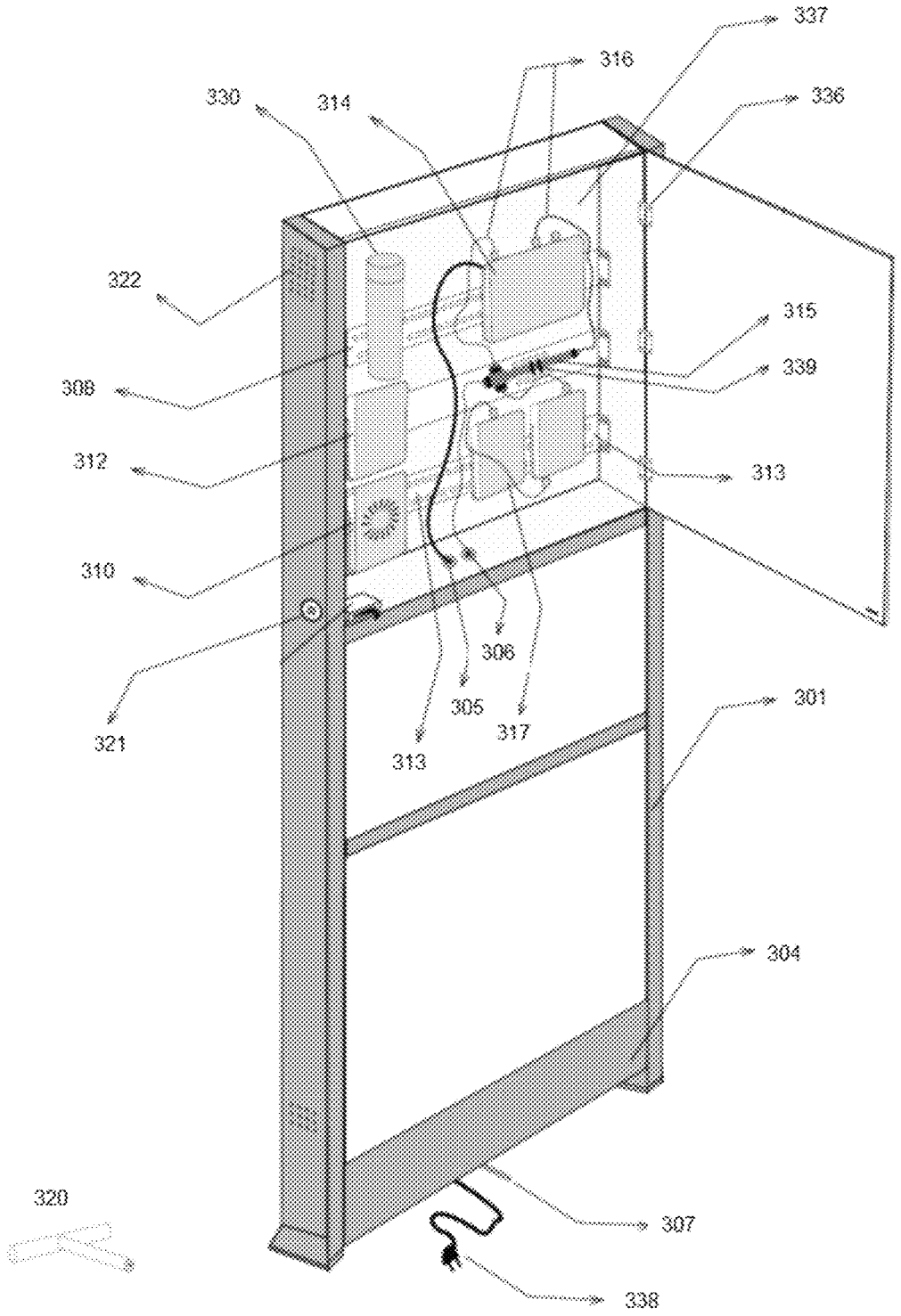
FIG. 10 shows another perspective view of the third exemplary advertising medium in the form of a totem/monolith with the cover open.
Figure 11:
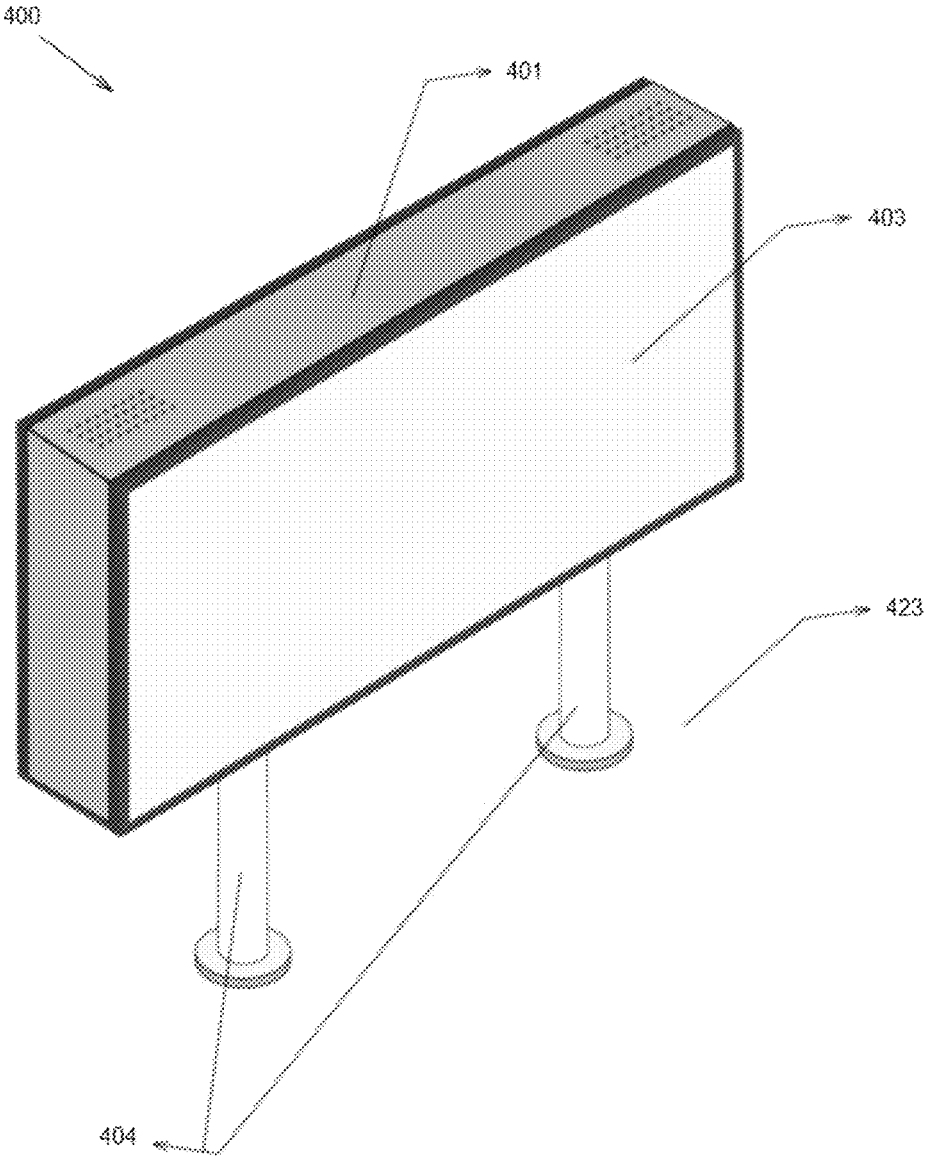
FIG. 11 shows a perspective view of a fourth exemplary advertising medium in the form of a billboard.
Figures 12A, 12B:
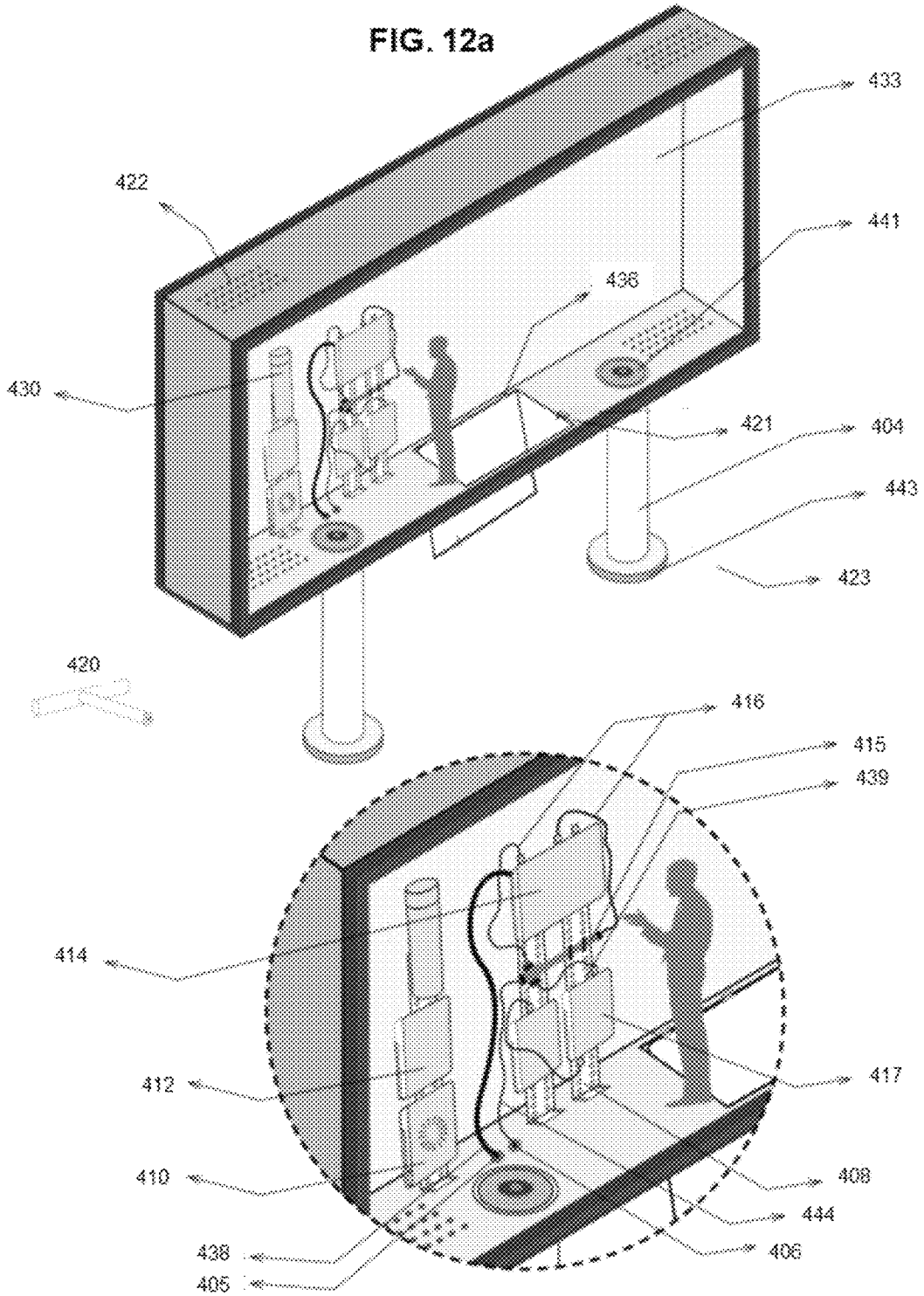
FIGS. 12*a* and 12*b* show perspective views of the fourth exemplary advertising medium where a panel is eliminated to show the interior.
Figure 13:
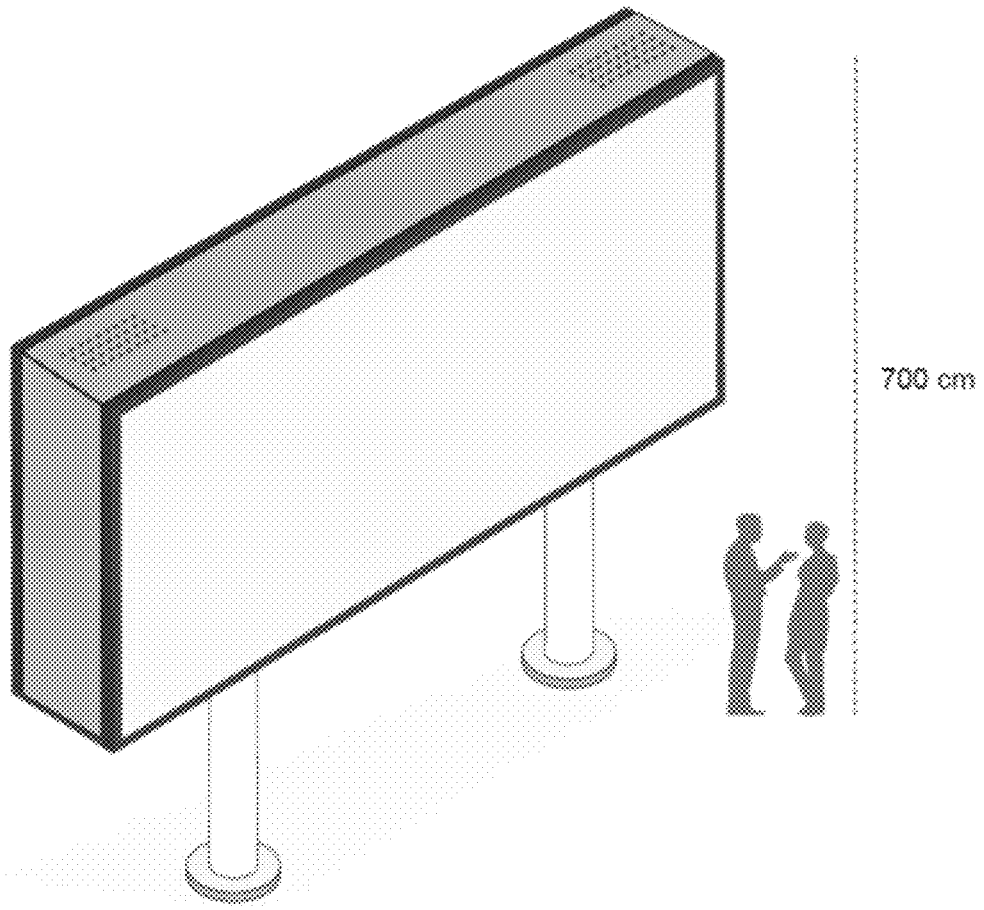
FIG. 13 shows another schematic view of the fourth exemplary advertising medium fixed to the ground.

In the following, four examples of advertising mediums (100, 200, 300, 400) according to the present invention are disclosed, each of which corresponding to a different configuration: pennant, banner, monolith, and billboard.

Advertising Medium in the Form of a Pennant

A preferred, non-limiting embodiment of the present invention is made by means of the following elements: a lacquered perimetral aluminium frame (101), internally luminous (102), rectangular, and front panels (103) made of methacrylate and customized with vinyl.

For the installation, in a position in perpendicular to the plane of the façade of the building or of the surface, it has fixation means (104) of the advertising medium in the form of a pennant (100). At the side parallel to the plane of the façade of the building and closes thereto, the aluminium frame (101) has an outlet (105), circular having an insulating plastic gasket protecting from external weather conditions, through which 220V/12V electrical supply is provided to the 5G mobile cell antenna and the auxiliary telecommunication equipment.

On the side parallel and closest to the plane of the façade of the building or of the surface, the aluminium frame (101) has an outlet (106), circular and having an insulating plastic gasket for protecting against external weather conditions, through which an optic fibre is connected to the 5G mobile cell antenna (130) and the auxiliary telecommunication equipment.

Similarly, the optic fibre cable has a special duct in the form of a flexible duct (107) for protecting the optic fibre from the base to the 5G mobile cell antenna (130) in the advertising medium in the form of a pennant (100) and the auxiliary telecommunication equipment.

At the side in parallel and closest to the plane of the façade of the building, the frame (101) internally has a plate having a connection (108) for holding, at least, a 5G mobile cell antenna (130) or a box covering the one or more 5G mobile cell antennas.

At the side in parallel and closest to the plane of the façade of the building or of the surface, the frame (101) internally has another plate having a connection (109) for holding, at least, a forced ventilation system by means of, at least, one fan unit (110) and/or extractor having, in turn, a temperature controller activating automatically from a certain temperature.

At the side in parallel and closest to the plane of the façade of the building or of the surface, the frame (101) internally has another plate having a connection (111) for holding, at least, one watertight electrical panel unit having electrical protection equipment including magneto thermal and/or differential switches (112).

At the side in perpendicular to the plane of the façade of the building or of the surface, the frame (101) internally has another place having a connection (113) for holding, at least, a radio transmission and reception equipment (114), based on electromechanics for treating and processing electrical signals, and having, at least, a coaxial cable separator (115) for interconnecting a plurality of coaxial cables (116) with the different telecommunication units distributed inside the advertising medium in the form of a pennant.

At the side in perpendicular to the plane of the façade of the building or of the surface, the plate having a connection (113) also allows for holding, at least, one baseband processing unit (117).

Illumination takes place by means of modules or low power LED stripes (102) provided perimetrally and internally along the aluminium frame (101) along with a transformer (118), similarly provided at one of the internal sides of the aluminium frame.

One of the front panels is a door having watertight gaskets and assisted by, at least, one gas dampener (119) coupled to the interior structure of opening. At the upper internal side and in perpendicular to the opening motion at least a join, preferably of stainless steel, is provided. It can be opened by a coded key (120) which, after actuating the lock (121) provided at the lower side of the frame (101), the opening system opens the door a predetermined angle allowing for the operator to access easily to the 5G mobile cell antenna.

At the side in parallel and closest to the plane of the façade of the building or of the surface, the aluminium frame hasta a group of small boreholes (122), circular, as a ventilation system.

The advertising medium in the form of a pennant that repeats a 5G telephone signal (100) is situated at a minimum recommended height, without limitation, of three hundred centimetres (300 cm) over the surface of the street or ground (123). The recommended overhang distance, without limitation, will be of eighty centimetres (80 cm). The recommended vertical dimension, without limitation, is ninety centimetres (90 cm). The recommended thickness, without limitation, is at least fifteen centimetres (15 cm).

Advertising Medium in the Form of a Banner

A preferred, non-limiting embodiment of the invention is made from the following elements: an accessible aluminium structure in parallel to the façade having a frame (201), with a rectangular shape closed on two sides (203), having two masts (231) made of glass fibre in a position in perpendicular to the façade that have been fixed by means of a connection system (232) to the accessible structure in parallel to the façade, where in said masts, internally, a space (233) is provided for housing, at least, one 5G mobile cell antenna (230) having reasonable dimensions, without limitation.

The printable advertising body or banner (234), with a rectangular shape having non limited design and dimensions, is made of a flexible plastic material and customized by digital printing for creating publicity and a signalling message. The printable advertising body is fixed to, at least, one of the masts by means of non-limiting connection system such as a perimetral turn-up (235).

For installation, carried out in a position in parallel to the plane of the façade of the building or of the surface, it has, at least, one fixation means (not shown) for supporting the accessible structure of the advertising fabric banner that repeats a 5G telephone signal (200).

At the frontal plane visible in parallel to the façade of the accessible structure of the advertising fabric banner that repeats a 5G telephone signal (200), an articulated door having watertight gaskets and assisted, coupled to the structure at the internal side or sides in perpendicular to the opening motion by two stainless steel hinges (236) for access. It has an opening system by means of a coded key (220) which, after actuating the lock (221), provided at a side of the frame, the opening system opens the door a predetermined angle allowing the operator to easily access the suitable telecommunication equipment for allowing a correct operation of the mobile cell antennas.

At the internal space (237) of the accessible structure in parallel to the façade of the advertising fabric banner that repeats a 5G telephone signal (200), for ensuring a correct operation of the signal an equipment comprising a set of passive systems is provided with, at least, a coaxial signal separator (215), a plurality of coaxial cables (216), and a set of active systems among which there is, at least a radio transmission and reception equipment (214) based on electromechanics for treating and processing the electrical signals.

Similarly, and in order to ensure a correct operation of the signal and in an independent fashion, inside the internal space of the accessible structure parallel to the façade of the advertising fabric banner that repeats a 5G telephone signal (200) at least one baseband processing unit (217) is provided.

At, at least, one of the sides of the accessible structure, a grouping of small boreholes (222), circular or square without limitation as to the design, volume, and number, as a natural ventilation system.

As a refrigeration reinforcement for ensuring a good operation under adverse weather conditions of the telecommunication equipment housed inside the accessible structure of the advertising fabric banner that repeats a 5G telephone signal (200) a forced ventilation system is provided by means of, at least, a fan unit (210) and/or extractor having, in turn, a temperature control system activating automatically from a certain temperature.

Inside the accessible structure of the advertising fabric banner that repeats a 5G telephone signal at least a watertight electric panel unit (212) is provided having electrical protections with magneto thermal and/or differential switches.

At the parallel side closest to the plane of the façade of the building or surface, the aluminium frame has a circular opening (205), without limitation, having a lining of insulating plastic material for protecting against external weather conditions, through which an electric 220V/12V supply line (238) is provided both to the suitable telecommunication equipment for the correct operation of the 5G mobile cell antenna and to the 5G mobile cell antenna itself camouflaged inside at least one of the masts.

Similarly, the optic fibre has a circular outlet (206), without limitation, having an insulating plastic material lining for protecting against certain external weather conditions, through which fibre is provided both to the telecommunication equipment and to the 5G mobile cell antenna.

At the side perpendicular to the plane of the façade of the building or surface, at the aluminium frame internally at least a connection plate (208) is provided for holding the suitable telecommunication equipment for a correct operation of the 5G mobile cell antenna.

In said connection plate of the suitable telecommunication equipment for the correct operation of the 5G mobile cell antenna small perforations are provided for holding (239) the several devices and the necessary wiring for the same.

The advertising fabric banner that repeats a 5G telephone signal (200) is situated at a minimum recommended height of, without limitation, three hundred centimetres (300 cm) over the surface of the street or ground (223).

Advertising Medium in the Form of a Monolith

A preferred, non-limiting embodiment of the invention is made by means of the following elements: an accessible metallic steel reinforced structure (301) having a particular volume and dimensions, without limitation, in the form of a post in perpendicular to the plane of the street or ground (323), with a rectangular shape, having a printable advertising body (303), with a rectangular shape having no limitation in dimensions and design, made in methacrylate and customized by digital impression, for creating advertisements and indicative signalling. The printable advertising body is fixed to the metallic steel reinforced structure by means of a fixation system of aluminium plates (340).

A digital visual system developed with LED technology (302) is provided for creating informative signalling messages. In the preferred, non-limiting embodiment, for ensuring a better understanding, the advertising totem/monolith (300) is like those present in gas stations, where the cost of the different fuel types.

For the installation, made preferably, without limitation, by means of foundations and in a position in perpendicular to the plane of the road or ground, it has, at least, a support, known as shaft (304) resting on a base supporting the advertising totem/monolith.

Internally there a confined space (337) is provided for the inclusion of the 5G mobile cell antenna or antennas (330) and of the suitable telecommunication equipment for a correct operation, with dimensions of a reasonable volume, without limitation.

At the backside of the advertising totem/monolith that repeats a 5G telephone signal (300) an articulated door is provided having watertight gaskets and assisted, coupled to the structure at the internal side or sides in perpendicular to the opening motion, by at least one hinge (336), preferably made of stainless steel, for access. It is opened by means of a coded key (320) which, after actuating the lock (321), provided at the side of the frame, the opening system opens the door a predetermined angle allowing the operator easy access to the suitable telecommunication equipment for the correct operation of the 5G mobile cell antenna.

Inside the accessible internal space (337) of the advertising totem/monolith that repeats a 5G telephone signal (300), to ensure a correct operation of the signal equipment is provided comprising a set of passive systems including, at least, a coaxial signal separator (315), a plurality of coaxial cables (316) and a set of active systems including, at least, a radio transmission and reception equipment (314), based on electromechanics for treating and processing the electrical signals.

Similarly, and to ensure a correct operation of the phone signal and in a completely independent manner, in the internal accessible space (337) of the advertising totem/monolith that repeats a 5G telephone signal (300) at least a baseband processing unit (317) is provided.

In, at least, one of the sides of the accessible structure a group of small boreholes (322) is provided, circular or square, with a design, volume, and quantity without limitation as a natural ventilation system.

As a refrigeration reinforcement for ensuring a correct operation in adverse weather conditions of the telecommunication equipment housed inside the internal accessible space of the advertising totem/monolith that repeats a 5G telephone signal (300) a forced ventilation system is provided by means of, at least, one fan unit (310) and/or extractor having, in turn, a temperature control system that activates automatically from a certain temperature.

In the internal accessible space of the advertising totem/monolith that repeats a 5G telephone signal at least a watertight electrical board (312) is provided having electrical protections with magneto thermal and/or differential switches.

At the parallel side of the internal accessible space of the advertising totem/monolith that repeats a 5G telephone signal (300) closest to the plane of the street or ground, it has an outlet (305), circular without limitation, with a protecting insulating plastic material lining, through which the electrical 220V/12V supply line (338) is provided both to the suitable telecommunication equipment for the correct operation of the mobile small cell antennas and to the 5G mobile cell antenna or antennas (330).

Similarly, the optic fibre cable has a circular outlet (306), without limitation, having a protecting insulating plastic material lining, through which fibre is provided both to the telecommunication equipment and to the 5G mobile cell antenna or antennas.

The optic fibre has a special duct in the form of a flexible duct (307) for protecting the optic fibre from the base to the 5G mobile cell antenna or antennas as well as all the necessary elements for a correct operation housed inside the advertising totem/monolith (300).

At the sides in perpendicular to the plane of the street or ground, at the aluminium frame internally there is provided a connection (308) for holding the 5G mobile cell antenna (330).

At the sides in perpendicular to the street or ground, in the aluminium frame internally there is provided at least a connection plate (313) for holding the suitable telecommunication equipment for the correct operation of the 5G mobile cell antennas.

At said connection plate of the suitable telecommunication equipment for the correct operation of the 5G mobile cell antenna small perforations (339) for holding the devices, as well as the necessary wiring, is provided.

The advertising totem/monolith that repeats a 5G telephone signal (300) is installed by means of foundations in perpendicular to the plane of the street or ground, with a recommended height of, without limitation, five hundred and fifty centimetres (550 cm) above the surface of the street or ground (323).

Advertising Medium in the Form of a Billboard

A preferred, non-limiting embodiment of the invention is made from the following elements: a reinforced accessible metallic aluminium structure (401) having predetermined, non-limited, volume and dimensions, connected by means of a coupling system (441) to two posts (404) preferably made, without limitation, in steel, in perpendicular to the plane of the street or ground (423).

It has, coupled to said structure, at least a large format graphic impression medium (403) in a rectangular shape with non-limited design and dimensions, made in canvas and customized by means of digital impression for creating advertisements and indication signals. The advertising body is connected directly to the reinforced metallic structure by means of a system of connectors.

For the installation of the posts, which takes place preferably, without limitation, by means of foundations in perpendicular to the plane of the street or ground (423), it has at least a post (404) resting on a base (443) supporting the billboard that repeats a 5G telephone signal (400).

Internally a confined space (433) is provided for housing the 5G mobile cell antenna or antennas (430) and the suitable telecommunication equipment for the correct operation, having dimensions of a reasonable volume, without limitation.

At the parallel side closest to the plane of the street or ground, the structure has, without limitation, an access in the form of an articulated door assisted, coupled to the structure the internal side or sides, by at least a hinge (436), preferably made of stainless steel, for access. It is opened by means of a coded key (420) which, after actuating the lock (421), provided at a side of the frame, the opening system opens the door a predetermined angle allowing for the operator to easily access the internal space of the advertising billboard that repeats a 5G telephone signal (400), where the mobile cell antenna or antennas and the suitable telecommunication equipment for the mobile cell antennas are housed.

Inside the accessible internal space (433) of the advertising billboard that repeats a 5G telephone signal, for a correct operation of the phone signal, equipment is provided comprising a set of passive systems including, at least, a coaxial signal separator (415), a plurality of coaxial cables (416); and a set of active systems including, at least, a radio transmission and reception equipment (414) based on electromechanics for treating and processing the electrical signals.

Similarly, and to ensure a correct operation of the phone signal and in a completely independent manner, inside the internal accessible space (433) of the advertising billboard having a (400) at least a baseband processing unit (417) is provided.

In, at least, one of the sides of the accessible structure, a group of small boreholes (422) is provided, circular or square without limitation in design, volume, and quantity, as a natural ventilation system.

As a refrigeration reinforcement for ensuring a correct operation under adverse weather conditions of the telecommunication equipment housed within the internal accessible space of the advertising billboard that repeats a 5G telephone signal (400) a forced ventilation system is provided by means of, at least, a fan unit (410) and or extractor having, at least, a temperature control system that activates automatically from a certain temperature.

At the internal accessible space of the advertising billboard that repeats a 5G telephone signal at least a watertight electric board unit (412) having electrical protections with magneto thermal and/or differential switches is provided.

The parallel side of the internal accessible space of the advertising billboard that repeats a 5G telephone signal (400) closest to the plane of the street or ground has an outlet (405), circular without limitation, with a protective insulating plastic material lining, through which the electrical 220V/12V supply line (438) is provided both to the suitable telecommunication equipment for the correct operation of the mobile cell antennas and to the mobile cell antenna or antennas (430).

Similarly, the optic fibre cable has a circular outlet (406), without limitation, having a protective insulating plastic material lining through which the fibre (444) is provided both to the telecommunication equipment and to the 5G mobile cell antenna or antennas (430).

The optic fibre has a special duct in the form of a flexible tube for protecting the optic fibre from the base to the mobile cell antenna or antennas and all the necessary elements for a correct operation housed inside the advertising billboard that repeats a 5G telephone signal.

Preferably, at the side closest to the plane of the street or ground, at the internal frame at least a connection (408) is provided for holding the 5G mobile cell antenna (430) and the suitable telecommunication equipment for the correct operation of the mobile cell antennas.

In said holding connection of the suitable telecommunication equipment for the correct operation of the mobile cell antennas small holding perforations (439) for the devices and the wiring are provided.

The advertising billboard that repeats a 5G telephone signal (400) is installed by means of foundations and in a position in parallel to the plane of the street or ground, with a recommended height of, without limitation, seven hundred centimetres (700 cm) over the surface of the street or ground.

The invention claimed is:

1. An advertising medium that repeats a 5G telephone signal, characterized by comprising:

a housing comprising a display with an advertising image, wherein said housing comprises a 5G mobile cell antenna;

an anchor configured to fix the housing to a wall or ground where it is to be installed; and outlets provided at the housing for the connection of a fibre optic cable and an electrical supply cable, the outlets connected to the 5G mobile cell antenna.

2. The advertising medium according to claim 1, where the housing is hermetic according to a superior grade IP65.

3. The advertising medium according to claim 1, where the housing is mainly made of a plastic material, methacrylate, glass fibre or ABS (Acrylonitrile Butadiene Styrene).

4. The advertising medium according to claim 1, where the housing houses a radio transceiver.

5. The advertising medium according to claim 1, where the housing houses a baseband processing unit.

6. The advertising medium according to claim 1, where the housing is further configured for housing an electrical board having magneto thermal and/or differential switches.

7. The advertising medium according to claim 1, where the housing houses an earth connection and a lightning protection device.

8. The advertising medium according to claim 1, further comprising a flexible duct protecting the optic fibre at the outlets of the housing.

9. The advertising medium according to claim 1, further comprising a connection plate inside the housing mounted to at least one of the 5G mobile cell antenna, the radio transmission/reception equipment and the baseband processing unit.

10. The advertising medium according to claim 9, where the connection plate comprises holes for holding cables.

11. The advertising medium according to claim 1, where the housing comprises an articulated door having watertight gaskets and gas pneumatic dampeners for facilitating opening.

12. The advertising medium according to claim 11, where the articulated door further comprises a lock that can be actuated by a coded key.

13. The advertising medium according to claim 1, where the housing further comprises a plurality of ventilation boreholes.

14. The advertising medium according to claim 13, further comprising a fan and a temperature control element activating the fan when a predetermined temperature is exceeded.

15. The advertising medium according claim 1, further comprising a plurality of illumination elements housed inside the housing.

16. The advertising medium according to claim 1 in a form of a pennant, where:

the housing has an essentially flat shape formed by a rigid perimetral frame and non-metallic side panels where the advertising image is provided; and the anchor is provided at the frame of the housing for allowing fixation to a vertical wall in the form of the pennant.

17. The advertising medium according claim 1 in a form of a banner, where:

the housing has an essentially flat shape formed by a rigid perimetral frame and side panels:

the anchor is provided at a first side of the housing for allowing fixation to a vertical wall with the side panels in parallel to said vertical wall;

the housing further comprises a mast fixed in perpendicular to a second side opposite the first side, such that the mast projects perpendicularly to the vertical wall; and the banner having an advertising image is-fixed to the mast.

18. The advertising medium according to claim 17, where a rod of the 5G mobile cell antenna is provided inside the mast.

19. The advertising medium according to claim 1 in a form of a monolith, where:

the housing has an essentially flat large size post or bipost shape comprising a reinforced perimetral structure and non-metallic front sides where the advertising image is provided; and the anchor comprises a foundation on which the housing is fixed to the ground as the monolith.

20. The advertising medium according claim 1 in a form of a billboard, where:

the housing has an essentially flat shape formed by a rigid structure and non-metallic sides fixed to the structure where the advertising image is provided; and the anchor comprises at least an essentially vertical rigid post protruding from the frame of the housing for its fixation to the ground in the form of the billboard.

* * * * *